US005456270A

United States Patent [19]

Wong

[11] Patent Number: 5,456,270

[45] Date of Patent: Oct. 10, 1995

[54] CROSS-CUT HAIRSTYLING DEVICE AND METHOD

[76] Inventor: Hilda C. Wong, 14701 Saltamontes Way, Los Altos Hills, Calif. 94022

[21] Appl. No.: 320,054

[22] Filed: Oct. 7, 1994

[51] Int. Cl.[6] ..... A45D 7/00; A45D 2/20; A45D 8/12

[52] U.S. Cl. ..... 132/210; 132/247; 132/275

[58] Field of Search ..... 132/210, 273, 132/275, 247, 248, 250; D28/39, 41

[56] References Cited

U.S. PATENT DOCUMENTS

| | | | |
|---|---|---|---|
| 1,346,920 | 7/1920 | Steinacher | 132/247 |
| 1,538,809 | 5/1925 | Henry | 132/247 |
| 2,242,549 | 5/1941 | Rose | 132/247 |
| 2,308,819 | 1/1943 | McFadden et al. | 132/247 X |
| 3,566,888 | 3/1971 | Bonarigo | 132/40 |
| 5,038,718 | 8/1991 | Pfleger | 119/106 |
| 5,044,385 | 9/1991 | Rhodes | 132/273 |
| 5,144,968 | 9/1992 | Rivera | 132/247 |
| 5,379,782 | 1/1995 | Tabb | 132/275 |

FOREIGN PATENT DOCUMENTS

| | | | |
|---|---|---|---|
| 934607 | 5/1948 | France | 132/248 |

*Primary Examiner*—Todd E. Manahan
*Assistant Examiner*—Elise P. Speaks
*Attorney, Agent, or Firm*—Schneck & McHugh

[57] ABSTRACT

A hairstyling device and method include forming a hollow tubular member that is semi-rigid but that includes opposed first and second circumferential cuts to accommodate flexing of the device. Midpoints of the first circumferential cuts are diametrically opposed to midpoints of the second circumferential cuts. Connecting mechanisms, such as fastening devices or materials, a handkerchief or a scarf, may be used to secure the device in an arcuate configuration, so as to achieve a desired hairstyle. In operation, the device is rolled through a person's hair to wrap the hair about the exterior of the tubular member. Preferably, hook material or the like is formed on the outside of the device to facilitate the wrapping of the hair. Then, the device is bent into the desired shape and is secured in place.

16 Claims, 9 Drawing Sheets

CROSS-CUT HAIRSTYLING DEVICE AND METHOD

TECHNICAL FIELD

The invention relates generally to hairstyling devices and methods and more particularly to devices for maintaining a desired hairstyle and affixing ornamental objects to a person's hair.

BACKGROUND ART

Devices for forming and maintaining a desired hairstyle are known. As one example, hairpins may be used to secure strands of hair in selected positions so as to create a desired configuration. Other examples include a nylon mesh form for creating a "French roll" and a donut-shaped hair "rat" for styling a bun or the like.

While prior art hairstyling devices that remain attached to a person's hair operate reasonably well for their intended purpose, there are some difficulties. Firstly, arranging the hair with these devices to obtain an attractive style may require skill beyond that possessed by most people. Thus, the aid of another person, such as a professional hairdresser, may be required. Obtaining assistance from another person is particularly important if hair is to be arranged at the back of a person's head. Another concern is that some of these devices cannot be used unless the person has relatively long hair.

Another concern is that the hairstyling devices themselves are often unattractive, detracting from the overall appearance. For example, standard bobby pins may reduce the attractiveness of a hairstyle.

Often, a person will wish to include an ornamental object, such as a specifically designed preformed bow, with a particular hairstyle. The ornamental objects may be difficult to maintain over time. Once a bow is flattened, rejuvenating its shape may require a professional cleaner or the time and effort of disassembling the bow, cleaning the fabric, and then reassembling the bow to a clip.

In addition to hairstyling devices for daytime use, there are devices for treatment of a person's hair. U.S. Pat. No. 5,144,968 to Rivera describes a permanent wave rod having a closed cell surface to prevent penetration of hair care solutions into the device. The permanent wave rod is for use by a hairdresser during application of hair permanent solution. The device has a cylindrical body that can be connected at opposed ends by use of pressure sensitive fabric, such as hook-and-loop material. After the person's hair has been wound onto a number of permanent wave rods, the hair treatment solution is applied to effect the degree of curl desired by a person. The rods are then removed. U.S. Pat. No. 3,566,888 to Bonarigo describes a hair curler that can be used without bobby pins to position the curler within a person's hair. The hair curler has a spiral slit that allows the cylindrical curler to be elongated. When released, the curler contracts to trap hair within the slit, thereby securing the curler in position. Pairs of hair-anchoring slits extend from the spirals to more firmly secure the curler in place by grasping some of the hair.

An object of the invention is to provide a hairstyling device and method that are easily implemented and that do not detract from the overall appearance of a hairstyle. Another object is to provide such a device and method that facilitate attaching ornamental objects that are not specifically designed for attachment to a person's hair, such as handkerchiefs, scarfs and flexible rods.

SUMMARY OF THE INVENTION

The above objects have been met by forming a hairstyling device to include a hollow tubular member that is semi-rigid, but that includes first and second circumferential cuts to accommodate flexure in opposed directions. The circumferential cuts cooperate to permit the device to be bent in any direction. The first circumferential cuts extend into the device so as to have midpoints that are at a side opposite to midpoints of the second circumferential cuts. That is, the first cuts extend into the tubular member at a side generally opposite to the second circumferential cuts. Because the tubular member is semi-rigid, the device is able to maintain its shape when in use within the hair of a person, thereby creating the appearance of enhanced fullness and ensuring that the desired hairstyle is maintained. However, the first and second circumferential cuts allow the semi-rigid member to be bent into a shape to achieve the desired hairstyle. Moreover, because the tubular member is hollow, objects such as scarfs and metal ties that are not specifically designed for attachment to hair can be threaded through the device and used to provide ornamentation.

In the preferred embodiment, the hairstyling device includes hair-grasping material on the exterior of the tubular member. For example, hook material having hooks that are configured to grasp human hair may be adhered to the surface of the tubular member. Also in the preferred embodiment is structure for securing the device in a bent condition when the desired hairstyle has been achieved. The securing structure may be a deformable metallic rod that extends through an axial bore through the tubular member. The deformable rod may be used to provide a "bridge" from one end of the tubular member to the other end when the tubular member is to be secured with a gap between the two ends. The bridge may be used to secure other objects within the person's hair. Alternatively, the securing structure may be cloth, such as a handkerchief or a scarf. If a cloth is used to connect opposed ends of the device, the cloth may be also used ornamentally, such as by forming a bow at the juncture of the ends of the tubular member. Other ornamental devices may also be used. Moreover, hook-and-loop material may be used to connect the opposed ends of the tubular member.

The first and second circumferential cuts are typically parallel, spaced apart slices into the tubular member. The first and second circumferential cuts alternate, so that the device can flex equally in opposite directions. However, alternating the cuts is not critical.

In use, the hairstyling device is brought into contact with a person's hair and is then rotated. Hair is wrapped around the device. The device is bent into a selected configuration in order to achieve a desired hairstyle. For example, the opposed ends may be joined to form a hair bun or knot. Alternatively, the bend of the device may be U-shaped. The semi-rigid material that forms the tubular member maintains the shape of the device, but the sets of circumferential cuts permit the desired flexibility.

An advantage of the invention is that a wide variety of hairstyles may be formed using the device. The combination of semi-rigid material that limits radial compression and circumferential cuts that permit bending permits use of the device in many manners. "Semi-rigid" is defined herein as material that resists deformation when used within a hairstyle. The semi-rigidity maintains the form of the device, and therefore the hairstyle, during use. The tubular aspect of the device achieves an appearance of enhanced hair fullness. The hollow aspect permits insertion of ornamental objects.

Hair-clinging material on the exterior of the tubular member may be colored as desired. As compared to the in-shop devices of Rivera and Bonarigo, the invention is to be worn during daily activities.

BEST MODE FOR CARRYING OUT THE INVENTION

Figure 1:
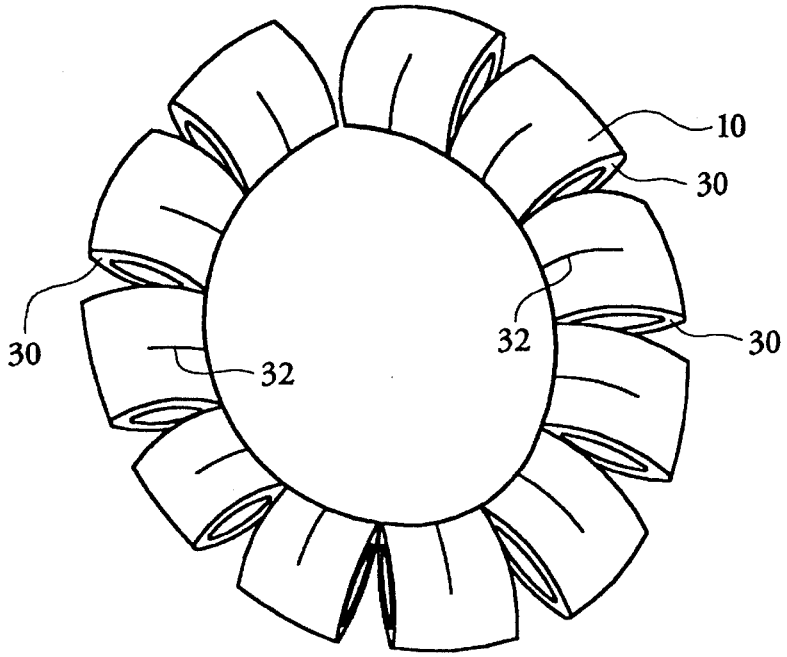
FIG. 1 is a perspective view of a tubular member of a hairstyling device in accordance with the invention.

With reference to FIG. 1, a hollow tubular member 10 is shown in a bent configuration to form a circle. The tubular member is preferably semi-rigid, but includes first and second circumferential cuts that cooperate to permit bending of the tubular member in any direction.

The dimensions of the tubular member are not critical. Acceptable dimensions of the hollow tube include a diameter of approximately 3.5 cm and a length of approximately 19 cm. The tubular member should be made of a material that is not plastically deformed by bending of the member. Moreover, the thickness of the material should be sufficient to resist tearing by repeated use of the tubular member. Preferably, the material is a polymer, such as vinyl. The difference between the inside diameter and the outside diameter of the tubular member is selected to resist tearing. An acceptable thickness may be within the range 0.1 and 0.3 cm.

Figure 2:
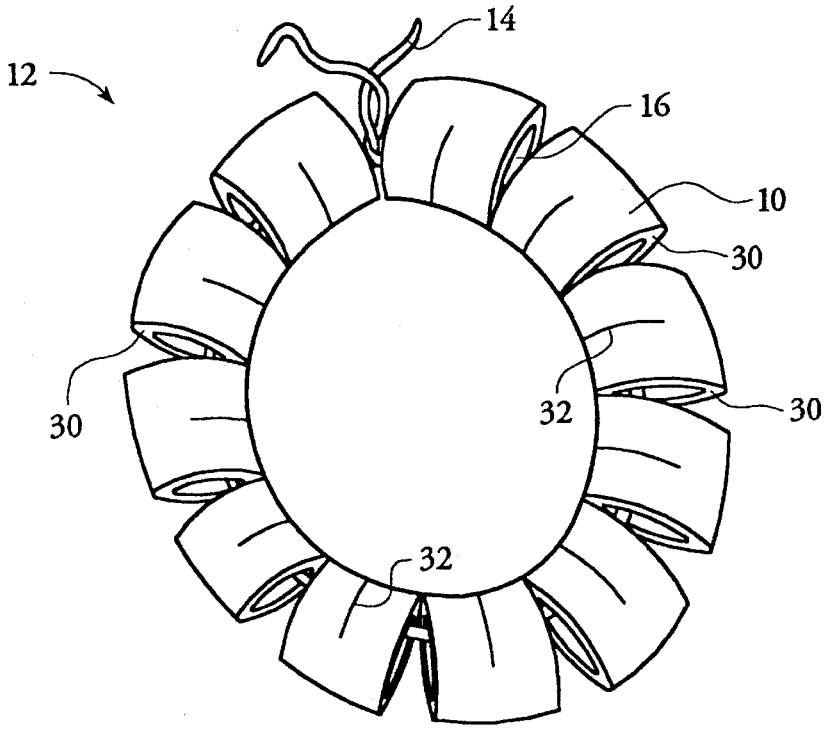
FIG. 2 is a perspective view of the hairstyling device having the tubular member of FIG. 1 and a deformable member for connecting opposed ends.

In FIG. 2, a hairstyling device 12 is shown as including the tubular member 10 and a tie 14. The tie extends through an axial bore 16 of the tubular member. The tie may be a metallic device clad in plastic that is deformable to allow bending of the tie at its opposed ends. The tie should have a length greater than that of the tubular member. In a preferred embodiment, the tie of FIG. 2 is replaced with a cloth, such as a handkerchief or a scarf. In this embodiment, the tie plays an important role in the overall look, since the handkerchief or scarf can be formed into a bow or other decorative design that is exposed.

Figure 3:
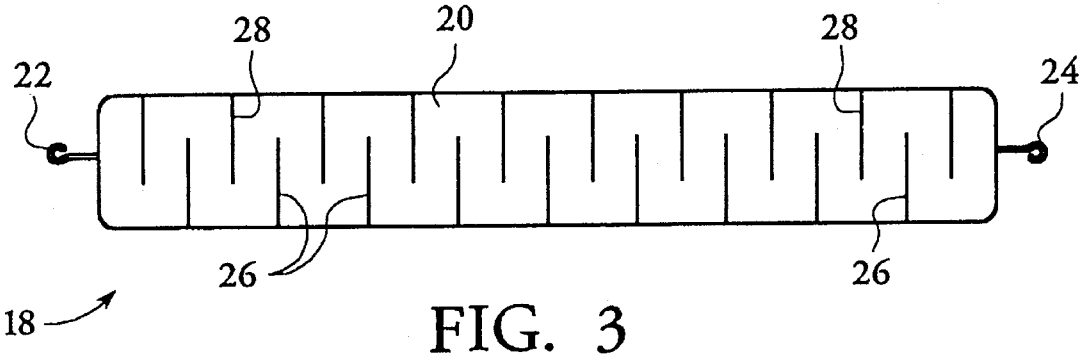
FIG. 3 is a side view of the tubular member of FIG. 1 having hooks at opposed ends to permit connection of the ends.

Referring to FIG. 3, a second embodiment of a hairstyling device 18 is shown in a relaxed condition. In this condition, a tubular member 20 extends linearly. However, connectors 22 and 24 are shown at opposed ends of the tubular member for fixing the device 12 in an arcuate condition. The connectors may be replaced with an appropriate arrangement of hook-and-loop material or with snaps.

In operation, the hairstyling device 18 is brought into contact with a person's hair. The device is then rotated in a manner to wrap the hair around the tubular member 20. The device is then flexed into an arcuate condition and the connectors 22 and 24 are linked to style a person's hair into a hair bun or other desired shape. Alternatively, the connectors 22 and 24 may be linked to other devices that are attached to the hair, providing an alternative hairstyle.

As previously noted, the material and/or structure of the tubular member 20 should be such that the device is semi-rigid. That is, the use of the device 18 within a person's hair should not cause substantial compression of the device. If the device were to be easily compressed, the resulting hairstyle would be less aesthetically pleasing. However, the rigidity would increase the difficulty of operation if first and second circumferential cuts 26 and 28 were not included. When the device is oriented as shown in FIG. 3, the first circumferential cuts extend upwardly to equal amounts in the opposed directions from the bottom of the tubular member 20. That is, the bottom of the tubular member is the midpoint of the first circumferential cuts 26.

Midpoints of the second circumferential cuts 28 are 180° removed from the midpoints of the first circumferential cuts 26. The first and second circumferential cuts are shown as being at a 90° angle to the axis of the device 18. This the preferred embodiment. Nevertheless, there may be some applications in which there is an advantage to forming the cuts at angles other than 90° to the axis.

The first circumferential cuts 26 accommodate bending of the hairstyling device 18 when the connectors 22 and 24 are moved upwardly from the position shown in FIG. 3. On the other hand, the second circumferential cuts 28 accommodate flexure of the device when the connectors are moved downwardly. The cuts should extend to a sufficient distance to permit the device to be easily flexed. The extent of the cuts is typically at least one-half of the circumference of the tubular member 20. Longer cuts increase the flexibility of the device, but the cuts should not be so deep as to severely localize stresses experienced by the material as the device is flexed. Returning to FIGS. 1 and 2, first circumferential cuts 30 are shown as extending almost entirely through the tubular member 10. Depending upon the choice of material for forming the tubular member, this may jeopardize the integrity of the tubular member upon repeated use of the device 12. Preferably, the length of the cuts is closer to that shown for a second set of circumferential cuts 32, but this is not critical.

Figure 4:
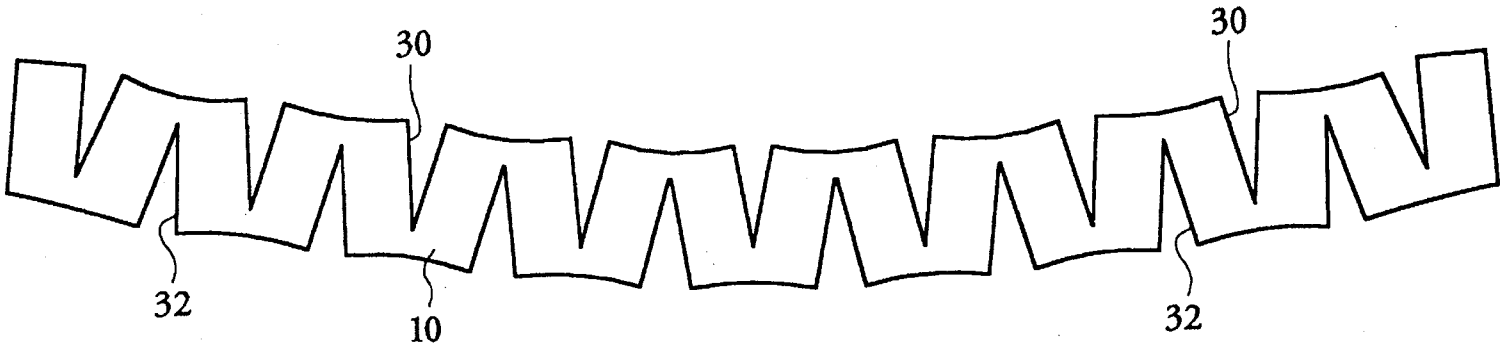
FIG. 4 is a side view of the tube of FIG. 1 in an elongated condition.

As previously noted, the tubular member 10 should have a low radial compressibility. However, expanding the device axially may be advantageous to achieving certain hairstyles. In FIG. 4, the tubular member 10 is shown as being stretched. The first and second circumferential cuts 30 and 32 accommodate the axial expansion and the bending of the device into the slightly arcuate condition of FIG. 4. The tubular member may be rotated to wrap hair about the exterior of the device, whereafter clasps may be used to secure the device in the slightly arcuate condition of FIG. 4.

Figure 5:
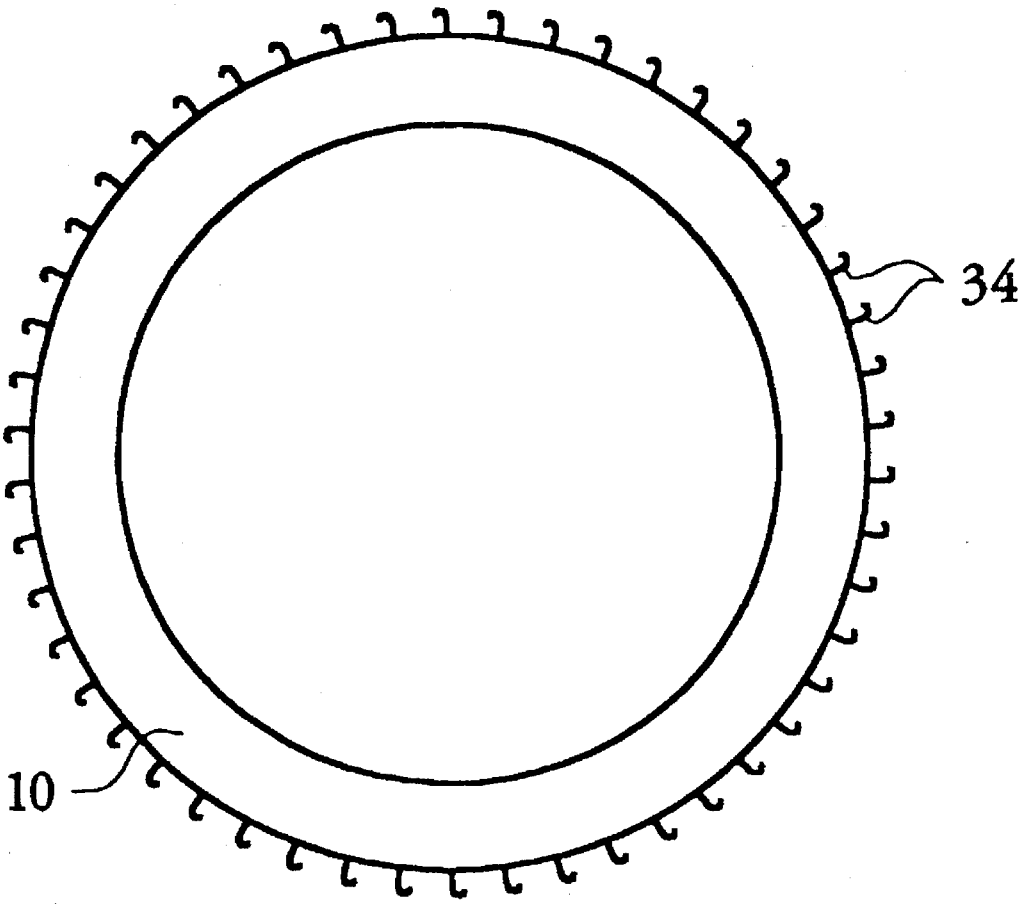
FIG. 5 is an end view of the hollow tube of FIG. 4 having hair-grasping material on an exterior surface.

To facilitate use of the device, the tubular member 10 preferably has a layer of material for clinging the device onto a person's hair. Referring to FIG. 5, an array of hooks 34 is shown about the exterior of the tubular member 10. The hook material is of the type used for pressure sensitive hook-and-loop devices. The hooks are configured to releasably grasp one or more human hairs. An acceptable length of a hook 34 from the exterior of the tubular member 10 is 0.3 cm.

Figure 6:
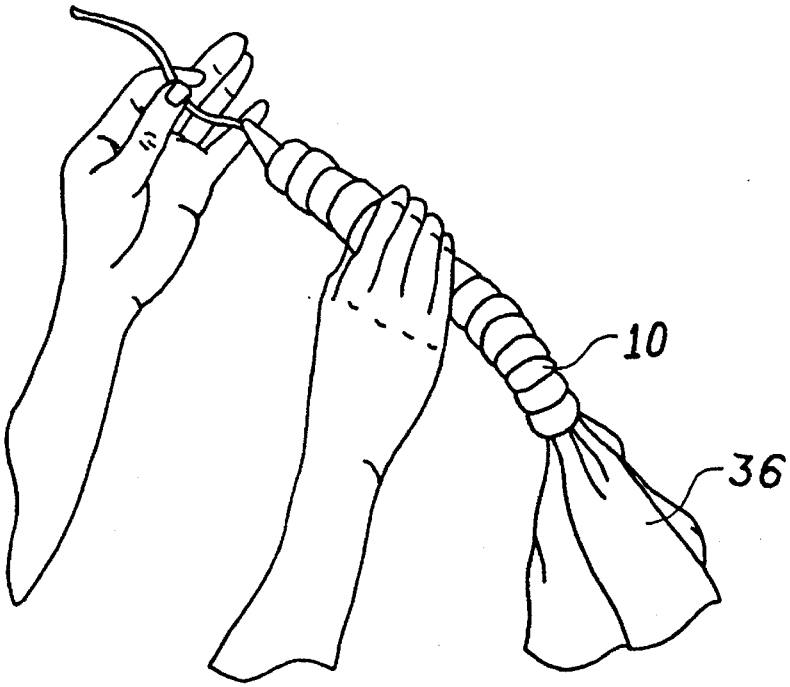
FIGS. 6–9 are perspective views of one method of using the tubular member of FIG. 1.
Figure 7:
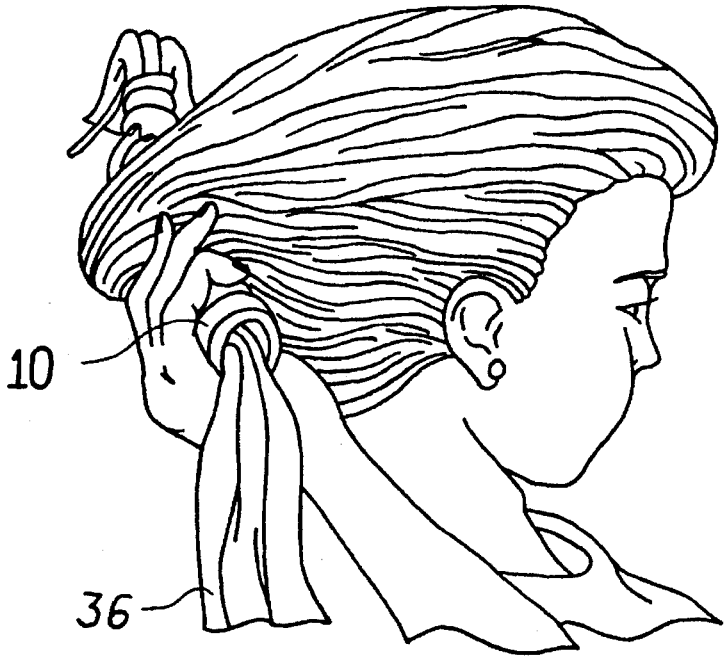

One method of using the device is shown in FIGS. 6–9. In FIG. 6, a cloth member 36, such as a scarf or a handkerchief, is threaded through the center bore of the tubular member 10. A rod or a threading device may be used to facilitate insertion through the tubular member. In FIG. 7, hair is wrapped around the tubular member, and the tubular member is rotated. As previously noted, hook material may coat the exterior surface of the tubular member in order to ensure that hair is firmly grasped.

Figure 8:
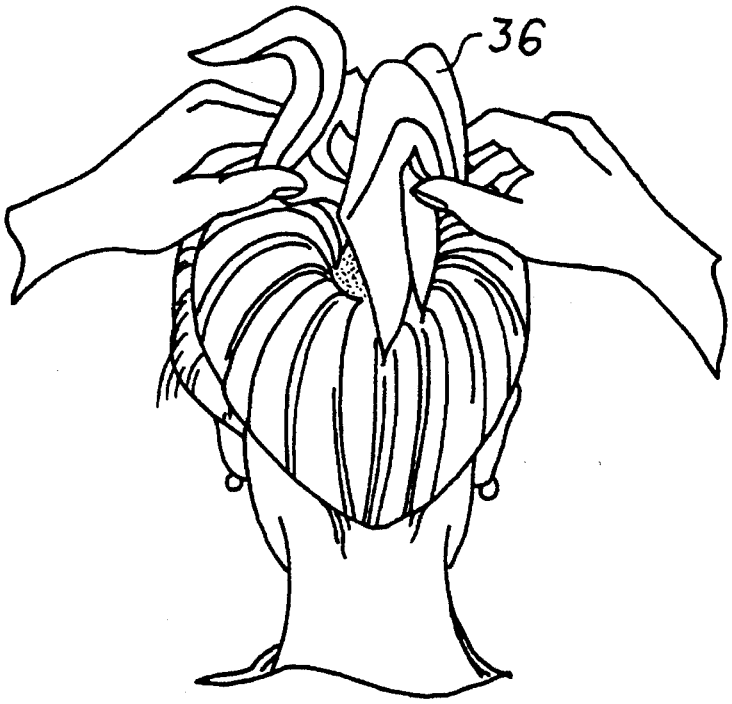
Figure 9:
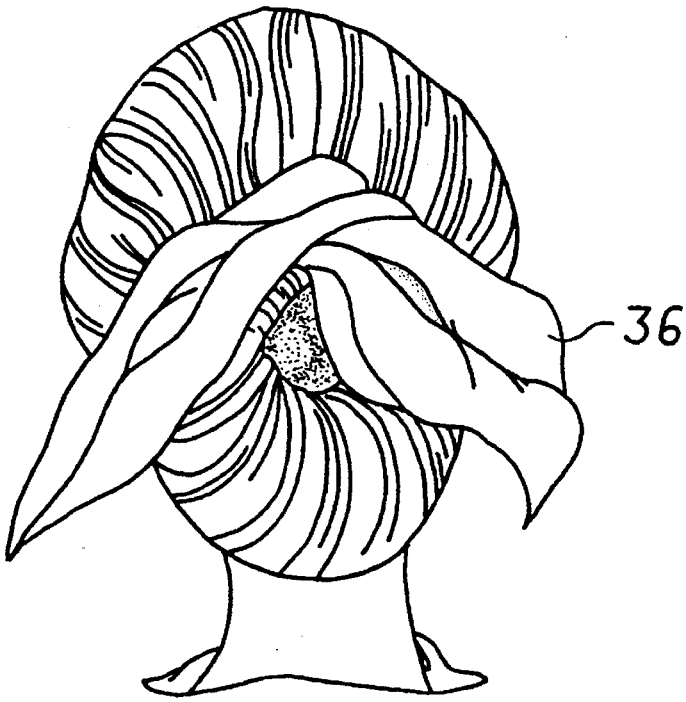
Figure 10:
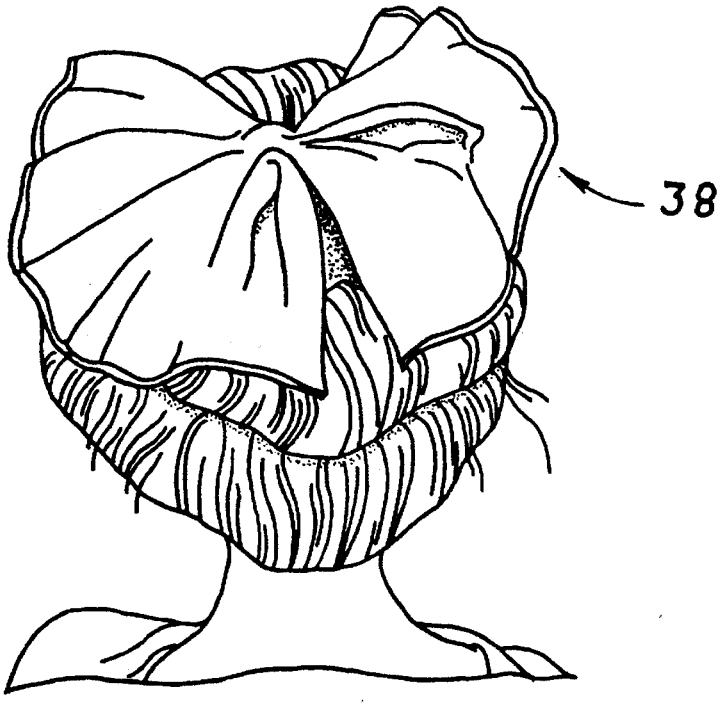
FIGS. 10–12 are perspective views of hairstyles maintained by use of the tubular member of FIG. 1, with cloth members providing ornamentation.
Figure 11:
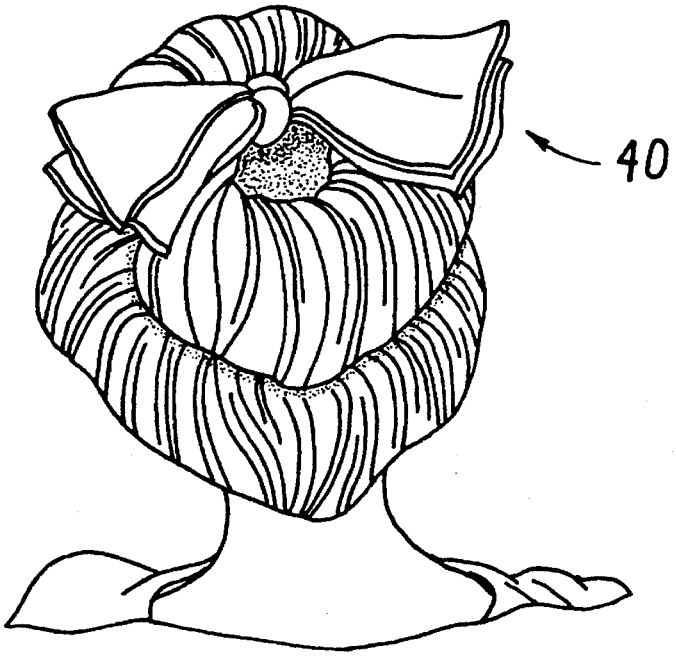
Figure 12:
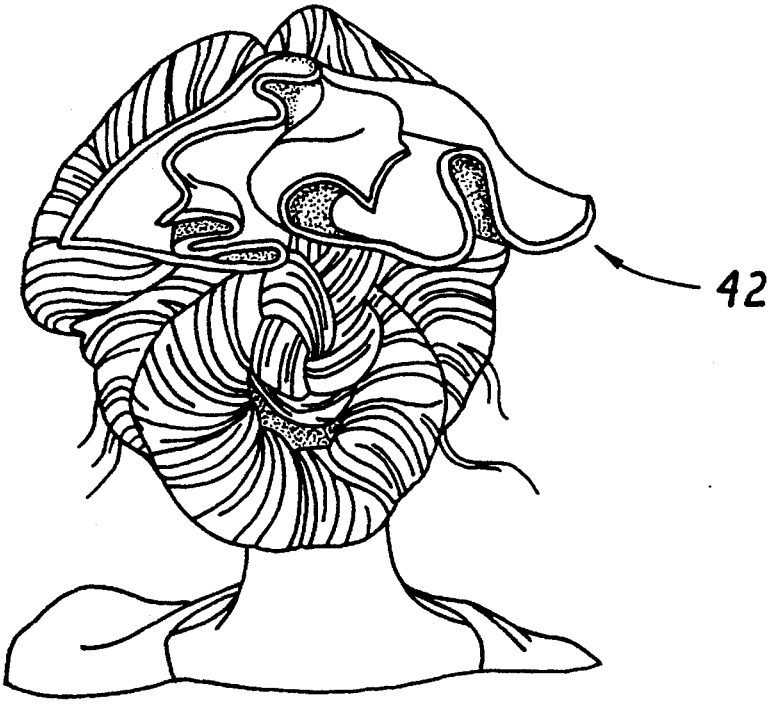

In FIG. 8, the opposed ends of the tubular member are brought together to form the desired hairstyle. Then, in FIG. 9, the cloth member 36 is tied to secure the tubular member in position. The cloth member is arranged according to the tastes of the wearer. FIGS. 10–12 show three styles 38, 40 and 42 for arranging a cloth member within a hairstyle achieved using the tubular member described above. FIGS. 10 and 11 show a hairstyle referred to as a "bun." FIG. 12 illustrates a hairstyle referred to as a "bun-N-braid."

Figure 13:
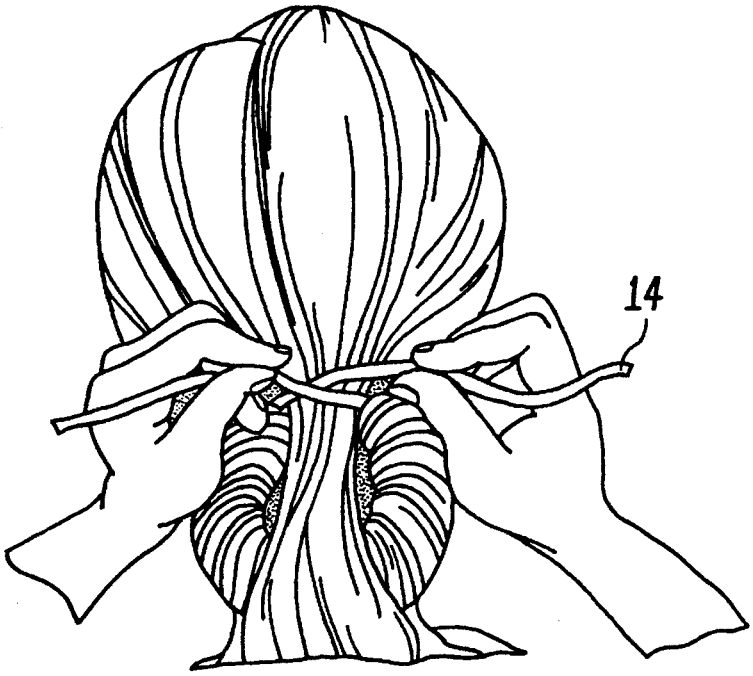
FIGS. 13–17 are perspective views of a second embodiment of using the tubular member of FIG. 1.
Figure 14:
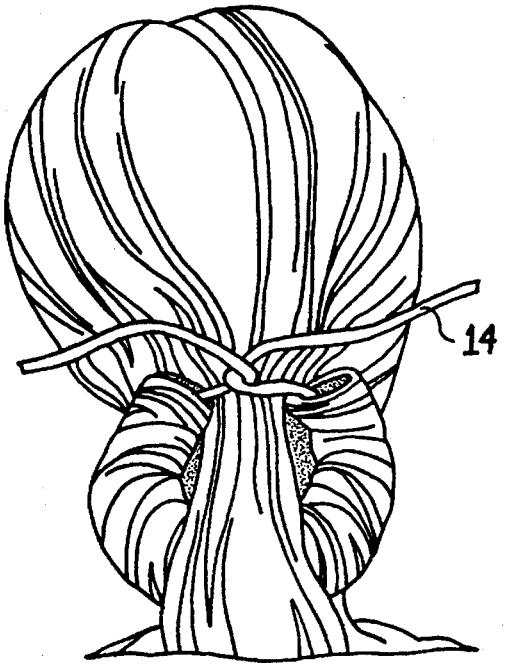
Figure 15:
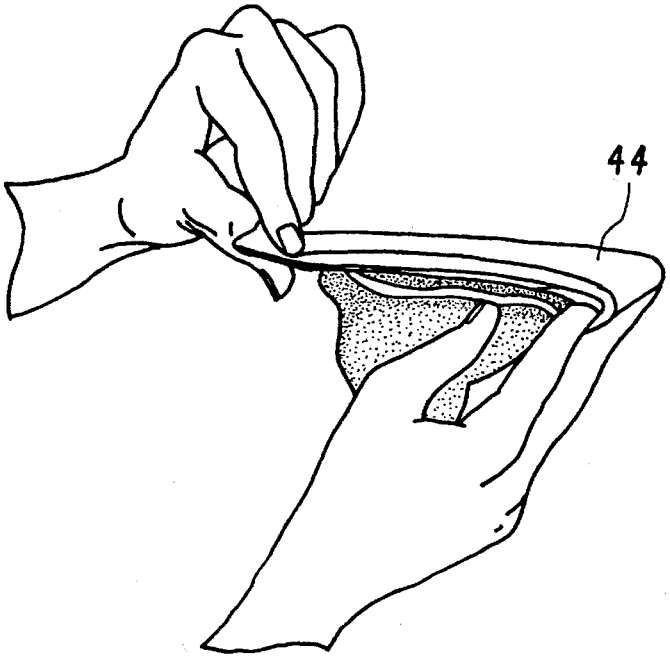
Figure 16:
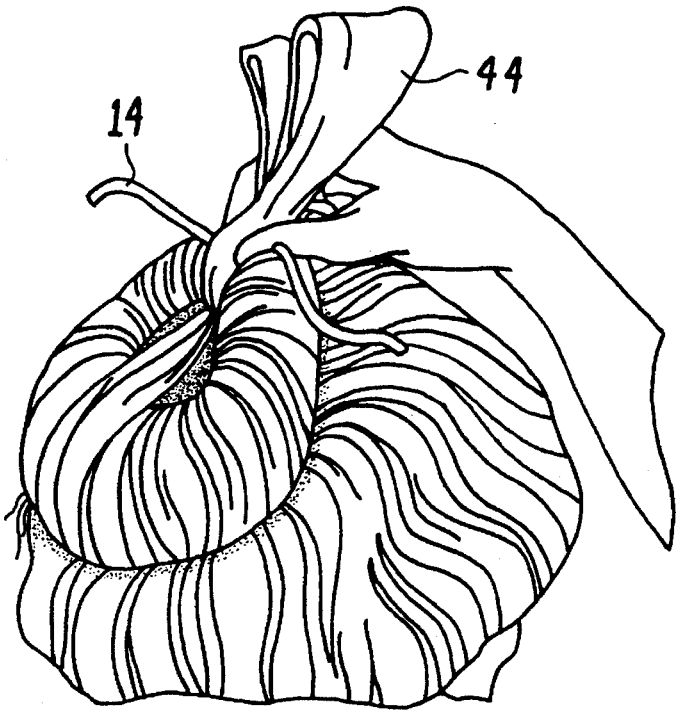
Figure 17:
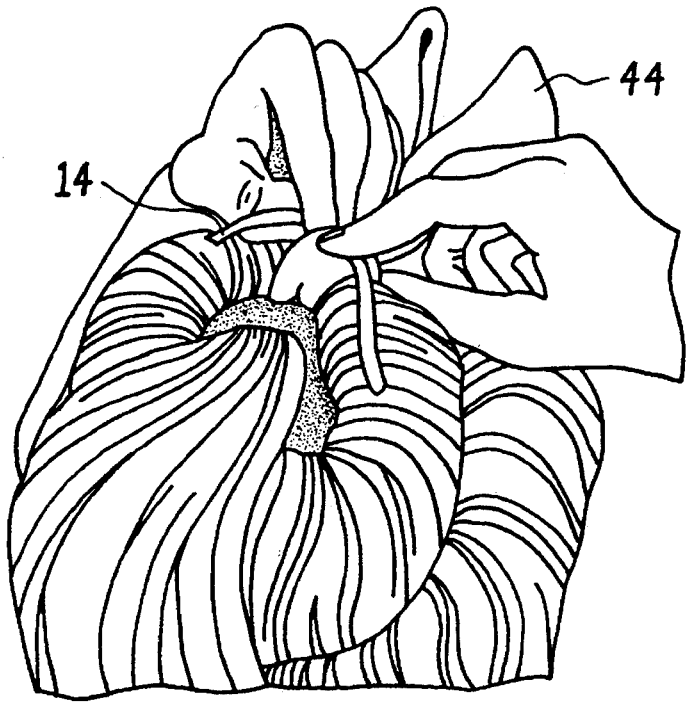

FIGS. 13–17 illustrate another embodiment of using the invention. In this embodiment, the tie 14 of FIG. 2 has been utilized, instead of a cloth member. In FIGS. 13 and 14, the tie 14 is first positioned and then twisted after the tubular member has been bent into a U-shape. The opposed ends of the tubular member are spaced apart, so that the tie 14 acts as a bridge. In FIG. 15, a cloth member 44, such as a handkerchief, is folded as desired. The particular fold will depend upon the user. In FIG. 16, the folded cloth member 44 is inserted into the person's hair at the bridge. FIG. 17 shows the user using the tie 14 to secure the cloth member in position. The cloth member can then be arranged according to taste, as previously noted with reference to FIGS. 10–12.

I claim:

1. A hairstyling device comprising:

a hollow tubular member having a diameter and having first and second sets of spaced apart circumferential cuts into said tubular member, said circumferential cuts of said first set having midpoints that are substantially diametrically opposed to midpoints of said circumferential cuts of said second set, said tubular member being semi-rigid, with said first set of circumferential cuts accommodating flexure in a first direction and said second set accommodating flexure in a second direction opposite to said first direction, said first and second sets being cooperative to permit the tubular member to be bent in directions other than said first and second directions, said tubular member having first and second ends, said tubular member being sufficiently long to permit said first and second ends to be in contact; and means for securing said tubular member in an arcuate condition when a person's hair is wrapped about said tubular member.

2. The device of claim 1 further comprising means for releasably adhering hair to an exterior of said tubular member, said means for releasably adhering including material attached to said exterior.

3. The device of claim 2 wherein said material has hooks configured to secure individual hairs.

4. The device of claim 1 wherein said tubular member is made of a polymer.

5. The device of claim 1 wherein said means for securing is a deformable rod extending through said tubular member from said first end to said second end.

6. The device of claim 1 wherein said means for securing is a cloth extending through said tubular member from said first end to said second end.

7. A hairstyling device comprising:

a hair-retaining member having a tubular shape in which an axial bore extends through the hair-retaining member, said hair-retaining member having a set of first cuts extending in parallel fashion through a portion of said hair-retaining member to accommodate bending in a first direction, said hair-retaining member further having a set of second cuts extending in parallel fashion, said second cuts being positioned relative to said first cuts so as to accommodate bending in a second direction different from said first direction; and means for holding said hair-retaining member to human hair, said means for holding including hair-clinging material about an exterior of said hair-retaining member.

8. The device of claim 7 further comprising tie means for connecting opposed ends of said hair-retaining member when human hair is wrapped about said hair-retaining member.

9. The device of claim 8 wherein said tie means is a deformable metal member having a length greater than a length of said hair-retaining member, said metal member extending through said axial bore of said hair-retaining member.

10. The device of claim 8 wherein said tie means is cloth.

11. The device of claim 7 wherein said means for holding is an array of hooks configured to grasp individual human hairs.

12. The device of claim 7 wherein said hair-retaining member is a semi-rigid polymeric tube.

13. A method of styling hair comprising:

providing a semi-rigid hollow tubular member having a circumferential surface;

forming spaced apart first and second circumferential cuts into said tubular member such that said first circumferential cuts have midpoints that are substantially diametrically opposed to midpoints of said second circumferential cuts;

contacting said circumferential surface to a person's hair;

rotating said tubular member such that said hair is wrapped about said circumferential surface;

bending said tubular member to style said hair; and securing said tubular member in an arcuate condition such that said style is retained.

14. The method of claim 13 wherein securing said tubular mender in an arcuate condition includes inserting an ornamental object through said tubular member and fixing opposed ends of said ornamental object together.

15. The method of claim 14 wherein inserting an ornamental object includes inserting a scarf or handkerchief.

16. The method of claim 13 wherein securing said tubular mender includes leaving opposed ends of said tubular member in spaced relation and includes forming a bridge from one of said ends to the opposed end for securing ornamental objects.

* * * * *